US006571862B1

(12) United States Patent
Wang et al.

(10) Patent No.: US 6,571,862 B1
(45) Date of Patent: Jun. 3, 2003

(54) HEAT DISSIPATING FIN

(75) Inventors: Jack Wang, 2, Ta-Chih Rd., Taoyuan City, Taoyuan Hsien (TW); Cheng-Hua Cheng, Taoyuan (TW); Michael Lin, Taoyuan (TW); Charles Ma, Taoyuan (TW)

(73) Assignees: Waffer Technology Corp., Taoyuan Hsien (TW); Jack Wang, Taoyuan Hsien (TW)

( * ) Notice: Subject to any disclaimer, the term of this patent is extended or adjusted under 35 U.S.C. 154(b) by 0 days.

(21) Appl. No.: 10/178,363

(22) Filed: Jun. 25, 2002

(51) Int. Cl.[7] ..... H05K 7/20

(52) U.S. Cl. ..... 165/80.3; 361/704; 361/710; 361/697

(58) Field of Search ..... 165/80.3, 185, 165/181, 182; 361/697, 704; 174/16.3

(56) References Cited

U.S. PATENT DOCUMENTS 2,692,763 A * 10/1954 Holm ..... 165/154
2,713,655 A * 7/1955 Grubman ..... 257/658
5,132,780 A * 7/1992 Higgins, III ..... 257/722
5,523,918 A * 6/1996 Chiou ..... 361/695
6,208,517 B1 * 3/2001 Prince et al. ..... 361/704
6,223,539 B1 * 5/2001 Bell ..... 62/3.7
6,321,584 B1 * 11/2001 Chen et al. ..... 72/295
6,411,510 B2 * 6/2002 Sasa et al. ..... 361/697

* cited by examiner

*Primary Examiner*—Allen Flanigan
(74) *Attorney, Agent, or Firm*—Rosenberg, Klein & Lee

(57) ABSTRACT

A heat dissipation fin includes multiple unit each having a top, a first side and a second side and multiple bridges each connecting every two adjacent units together and connected to each one of the units at a fold. The bridge has a front side and a rear side and the top of the unit has a first side in parallel with the front side and a second side in parallel with the rear side of the bridge. Each front side has a width smaller than a width of each rear side and each first side has a width smaller than a width of each second side.

12 Claims, 9 Drawing Sheets

HEAT DISSIPATING FIN

BACKGROUND OF THE INVENTION

1. Field of the Invention

The present invention relates to a heat dissipating fin, and more particularly to a heat dissipating fin made of a piece of metal and by pressing so as to have a continuous pattern and thus form an annular shape to adapt to wind direction of a heat dissipation fan to have the best heat dissipation effect. The heat dissipating fin has bridges, tops and sidewalls. The annular shape may be symmetric or asymmetric so that the flexibility of adapting the wind direction from the fan is enhanced.

2. Description of Related Art

As modern technology dramatically develops, electrical components easily generate heat due to high speed calculation. Because the electrical components can only function normally within a specific temperature range, maintaining the temperature within the predetermined temperature range is crucial in every electrical appliance. In order to accomplish the purpose, inventions are introduced to the market. However, no matter what kind of inventions are developed, the inventions are structurally fixed and have no flexibility to adapt to different mounting situations. That is, a heat sink can only deal with one mounting situation and needs a lot of embodiments to adapt to different mounting situations. Especially, after the heat dissipating fan is mounted to increase the heat dissipation effect, often the heat dissipation effect is not as good as expected. That is, the wind direction is not able to be adapted to the fin orientations. To accommodate the fin direction change to adapt to the wind direction of the heat dissipation fan is costly.

With reference to FIG. 8, a conventional heat dissipation assembly (80) is shown. The heat dissipation assembly (80) has a fin (81) mounted on top of a base (82). The fin (81) is integrally formed and has a continuous pattern. That is, the fin (81) has a undulated pattern.

With reference to FIG. 9, another conventional heat dissipation assembly (90) is shown and has multiple fins (91) spatially formed on top of a base (92).

Either one of the two conventional heat dissipation assembly (80,90) is not able to fully adapt to the wind direction of the heat dissipation fan (not shown) so that the heat dissipation effect is not as good as expected. That is to say, generally the wind direction of a heat dissipation fan is divergent relative to the center of the heat dissipation fan. When the divergent wind encounters the conventional heat dissipation assembly (80,90), because the fin (81,91) is fixed in one orientation, the wind can not take away heat of the fin (81,91) effectively.

To overcome the shortcomings, the present invention tends to provide an improved heat dissipation assembly to mitigate and obviate the aforementioned problems.

SUMMARY OF THE INVENTION

The primary objective of the present invention is to provide an improved heat dissipation fin adaptable to deal with wind direction of a heat dissipation fan so as to effectively dissipate heat. The heat dissipation fin is made of a piece of metal and by pressing. Controlling the widths of the bridges, the tops and sidewalls, the heat dissipation fin is symmetric or asymmetric in an annular shape so as that the wind direction is effectively accommodated.

Another objective of the present invention is to provide an improved heat dissipation fin having an undulated pattern.

The heat dissipation fin is composed of multiple U shaped units and each of the U shaped units is connected to one another via a bridge. Each U shaped unit has two side walls and a trapezoidal top face. Each trapezoidal top face has an inner side and an outer side in parallel to the inner side and having a length longer than that of the inner side, such that after each U shaped unit is connected to one another via the bridge, the inner sides of each of the U shaped units form an imaginary first circle and the outer sides of each of the U shaped units form an imaginary second circle. An extension of the joint of the bridge and a side of the U shaped unit passes through a center of both the first and second imaginary circles.

Still another objective of the present invention is that the extension of the joint of the bridge and a side of the U shaped unit is tangent to an imaginary circle enclosed by the undulated pattern of the fin.

Other objects, advantages and novel features of the invention will become more apparent from the following detailed description when taken in conjunction with the accompanying drawings.

DETAILED DESCRIPTION OF THE PREFERRED EMBODIMENT

Figure 1:
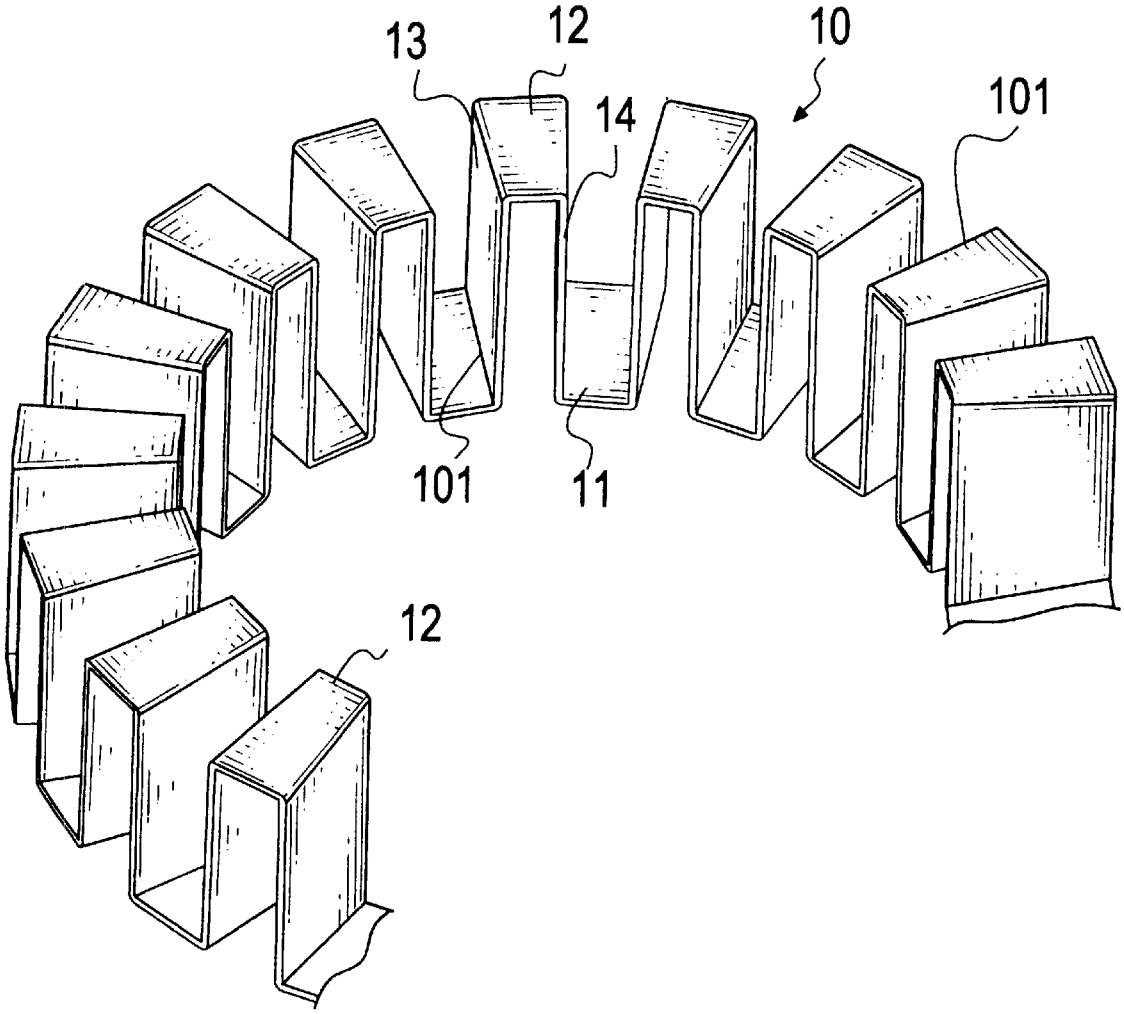
FIG. 1 is a perspective view of the first embodiment of the present invention.

With reference to FIG. 1, the first embodiment of the heat dissipating fin (10) in accordance with the present invention has a continuous pattern and is folded according to folds (101). The heat dissipating fin (10) includes first side walls (13), tops (12), second side walls (14) and bridges (11). The bridges (11) are arranged in a circular so that each of the folds (101) passes through an imaginary center of a circle. Each of the tops (12) are flush with each other. First distal ends, which faces the center of the circle, of both the bridges (11) and the tops (12) have a width smaller than the other distal ends of the bridges (11) and the tops (12).

Figure 2:
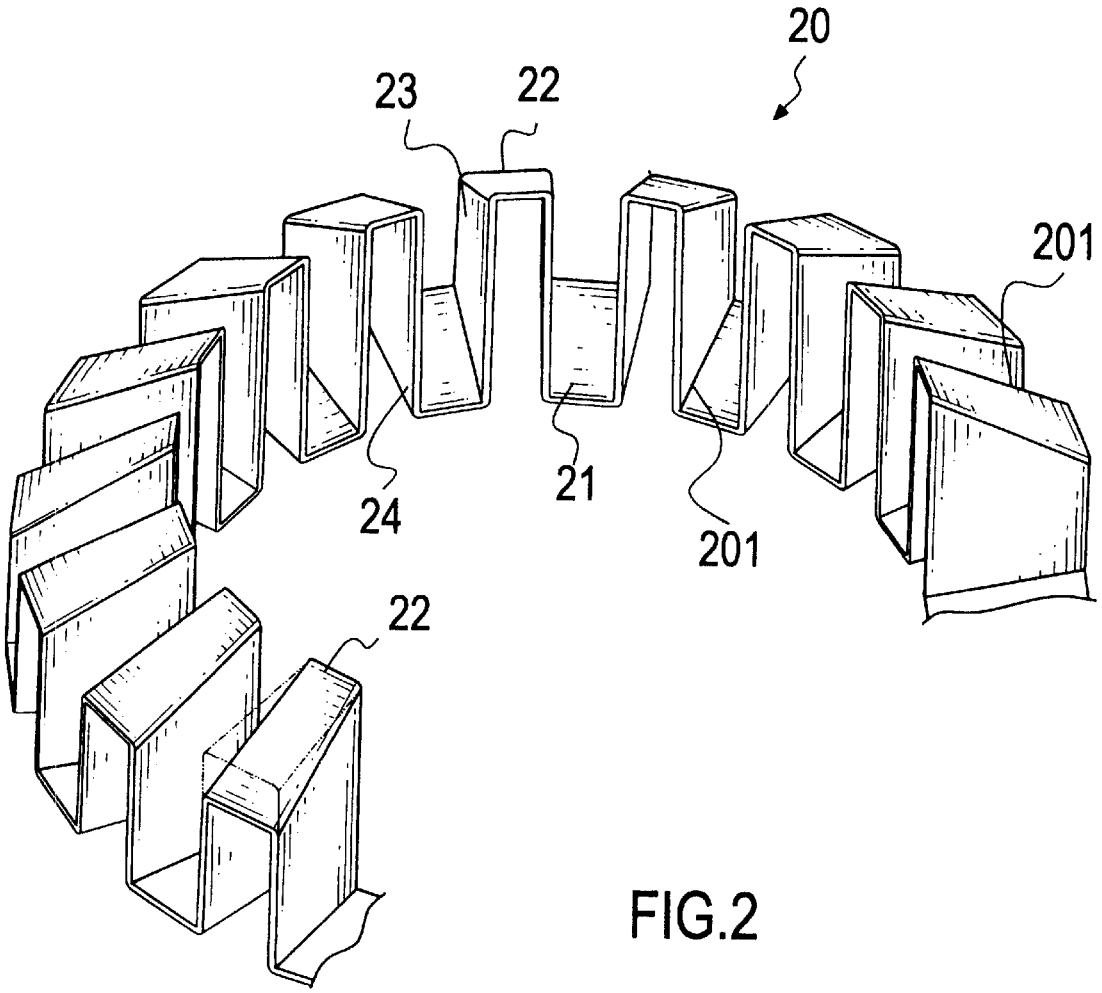
FIG. 2 is a perspective view of a second embodiment of the present invention.

With reference to FIGS. 2 and 3, the second embodiment of the present invention shows that the heat dissipating fin (20) is folded according to folds (201) to form a continuous pattern. The heat dissipating fin (20) includes first side walls (23), tops (22), second side walls (24) and bridges (21). The bridges (11) are arranged in a circular so that each of the folds (201) passes through an imaginary center of a circle. Each of the tops (12) are flush with each other. First distal ends, which faces the center of the circle, of both the bridges (21) and the tops (22) have a width smaller than the other distal ends of the bridges (21) and the tops (22). The tops (22) are inclined relative to the bridges (21) so that the first distal ends of the tops (22) have a height larger than the other distal ends of the tops (22).

Figure 3A:
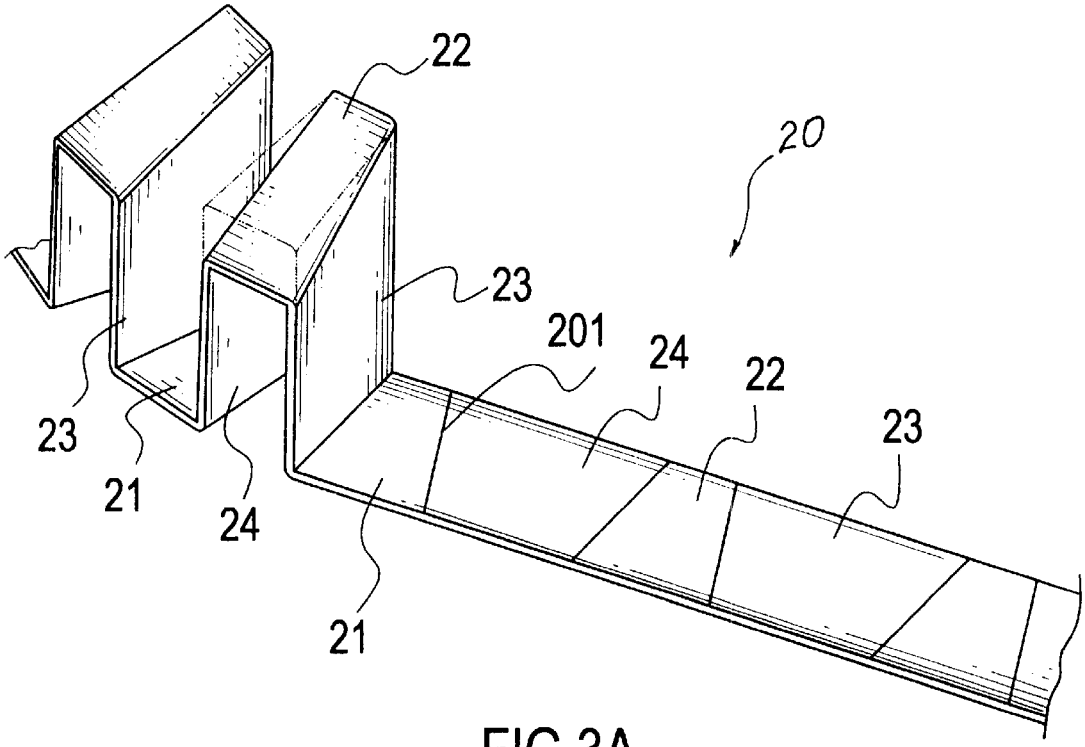
FIG. 3A is a perspective view showing that the second embodiment of the present invention as shown in FIG. 2 is made by an elongated plate.
Figure 3B:
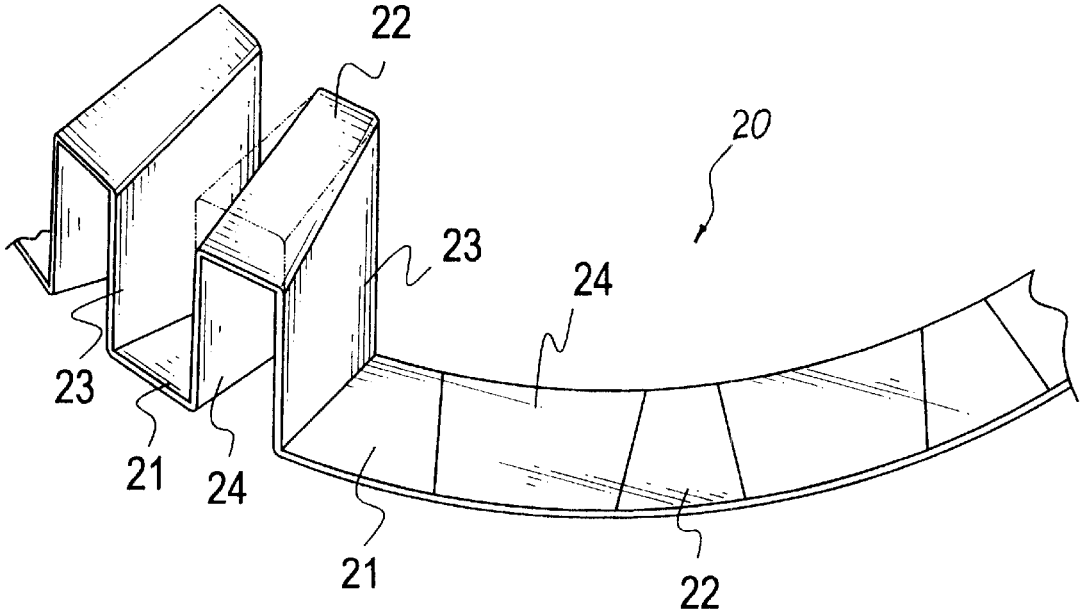
FIG. 3B is a perspective view showing that the second embodiment of the present invention as shown in FIG. 2 is made by an arcuate plate.
Figure 3D:
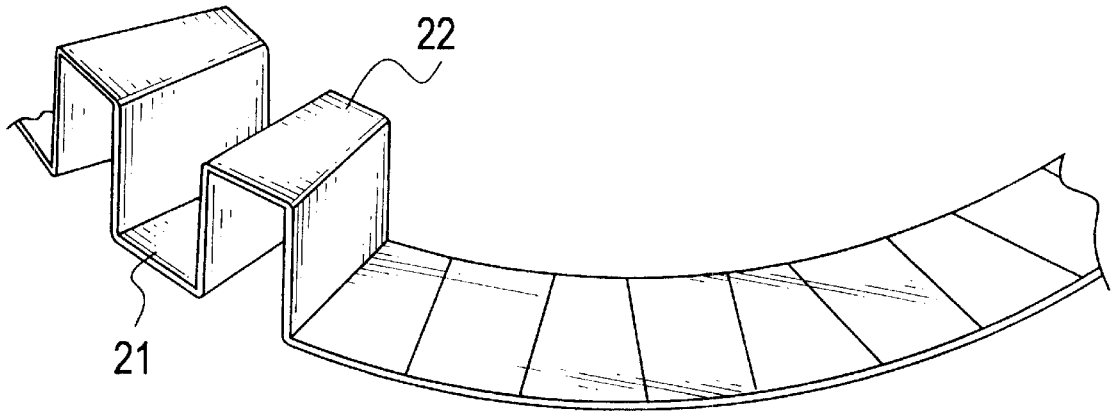
FIG. 3D is a perspective view showing that the first embodiment of the present invention is made by the arcuate plate.
Figure 3C:
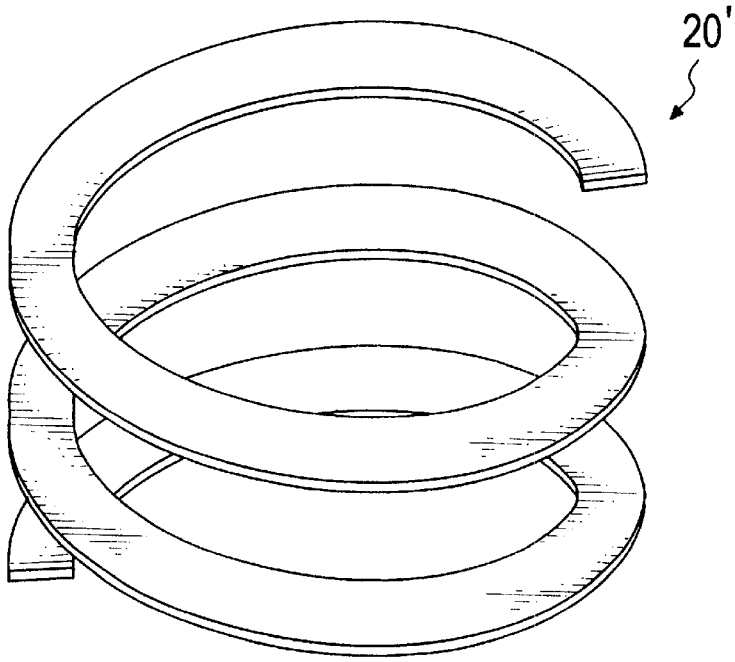
FIG. 3C is a perspective view of the arcuate plate before bending.

With reference to FIGS. 3A and 3B, the first side walls (23), the second side walls (24), the tops (22) and the bridges (21) are trapezoidal. Side walls of the first side walls (23) and the second side walls (24) are connected to the side walls of the tops (22) and the bridges (21). It is noted that the heat dissipating fin (20) in FIG. 3A is made of an elongated plate and the heat dissipating fin (20) in FIG. 3B is made of a spiral plate (as shown in FIG. 3C with the reference number (20')). FIG. 3D shows that the tops (22) are horizontal to the bridges (21).

Figure 4:
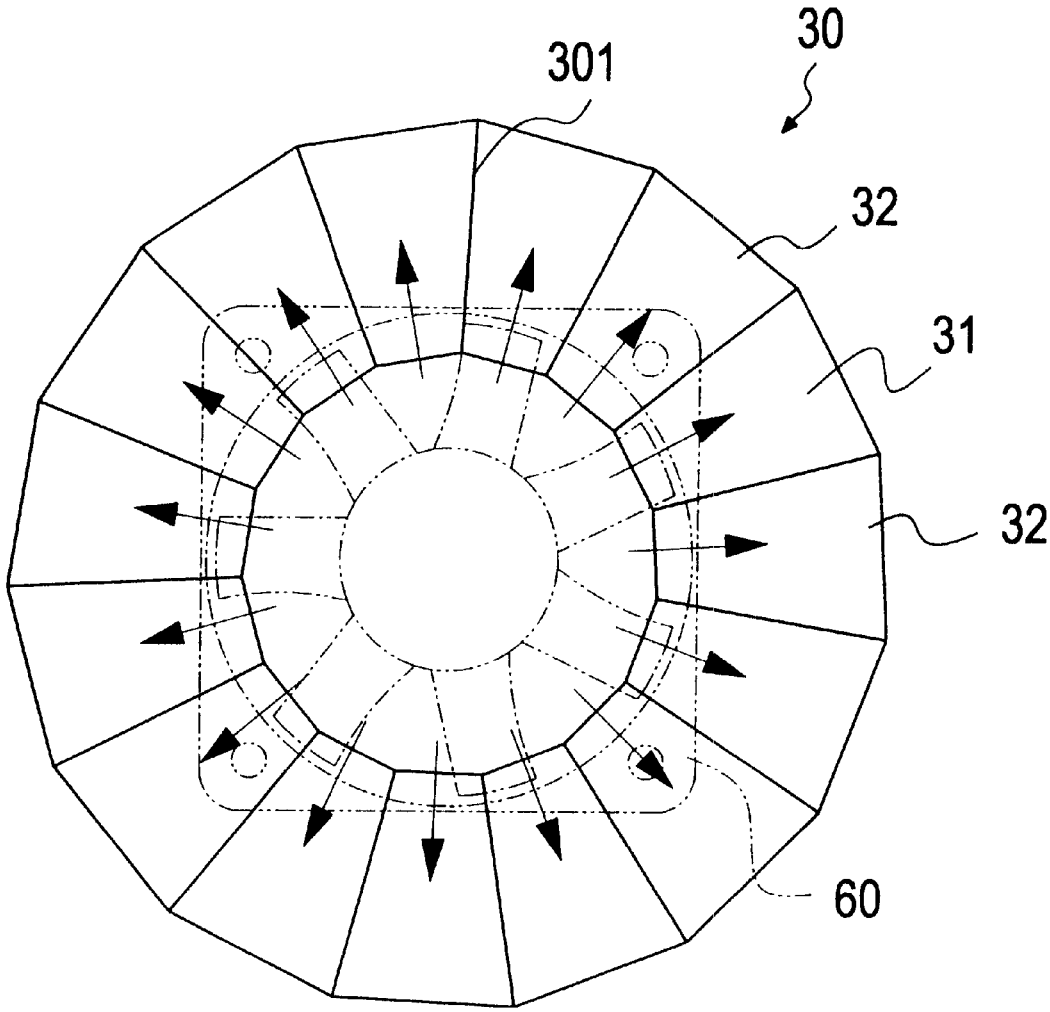
FIG. 4 is a top plan view showing the application of the first embodiment of the fin in association with a heat dissipation fan.

With reference to FIG. 4, the third embodiment of the invention shows that the heat dissipating fin (30) is arranged as a circle. A fan (60) is able to be mounted on top of the tops (32). The air flow generated by the fan (60) is divergent so that the heat dissipating fin (10,20,30) which is arranged in circle, arc or annular shape is able to have the maximum effect in heat dissipation.

Figure 5:
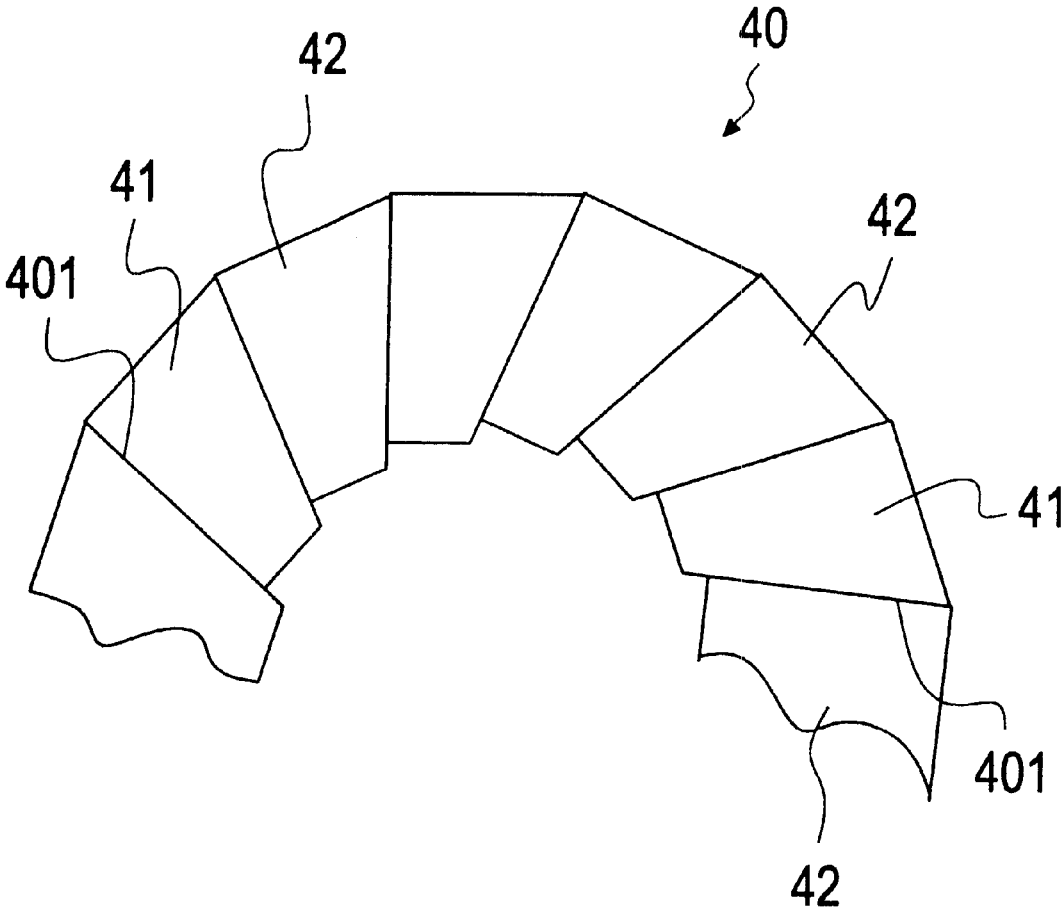
FIG. 5 is a top plan view showing the third embodiment of the present invention.
Figure 7:
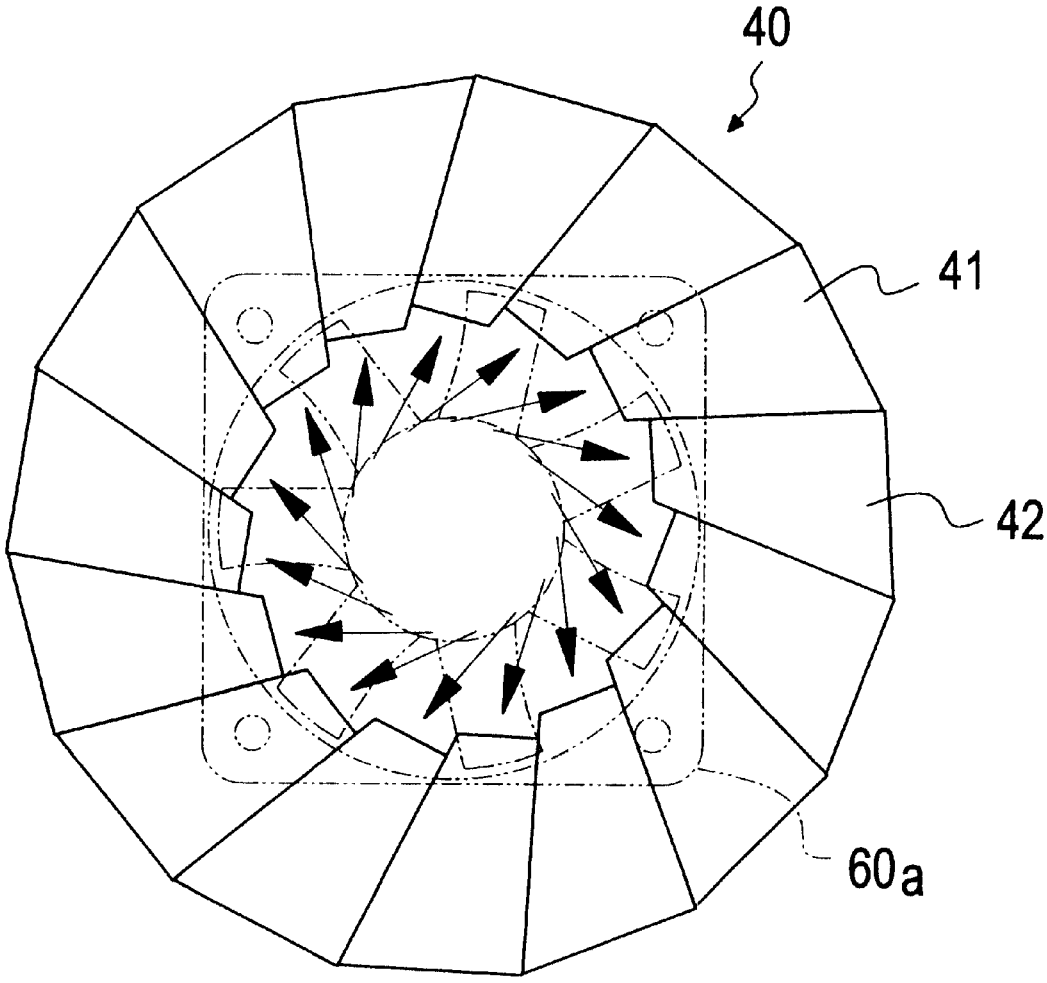
FIG. 7 is a schematic top plan view showing the application of the embodiment shown in FIG. 5 is in association with a heat dissipation fan.
Figure 8:
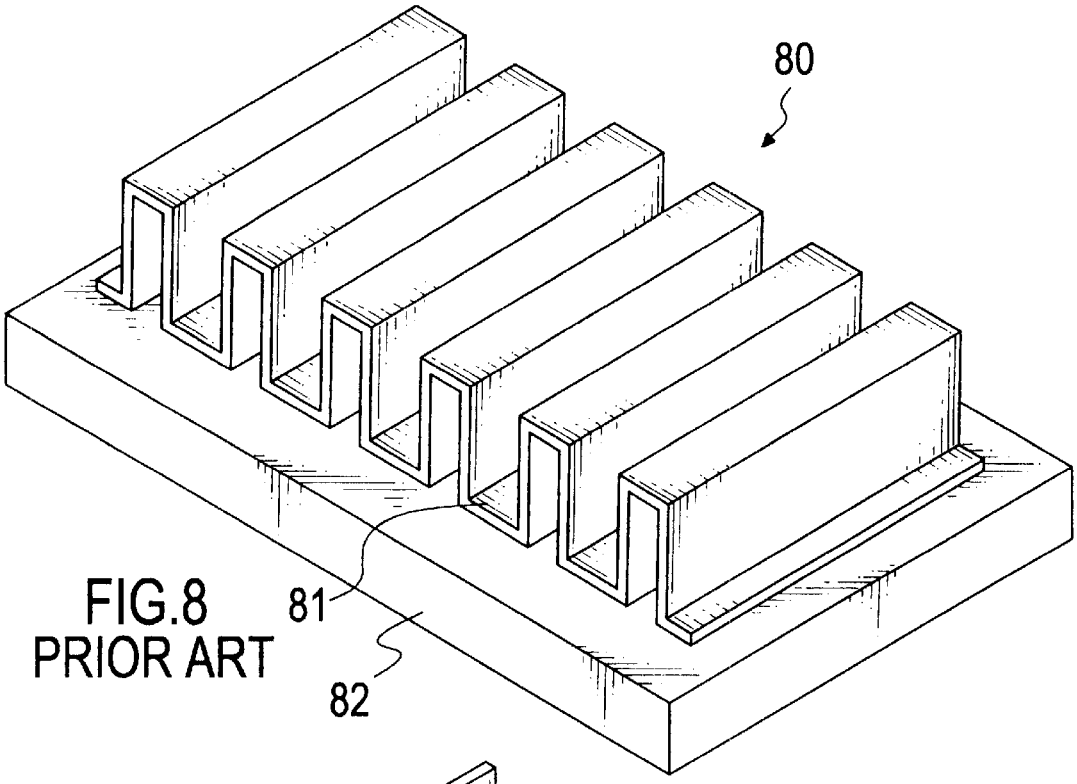
FIG.8 PRIOR ART
FIG. 8 is a perspective view of a conventional heat dissipation fin.
Figure 9:
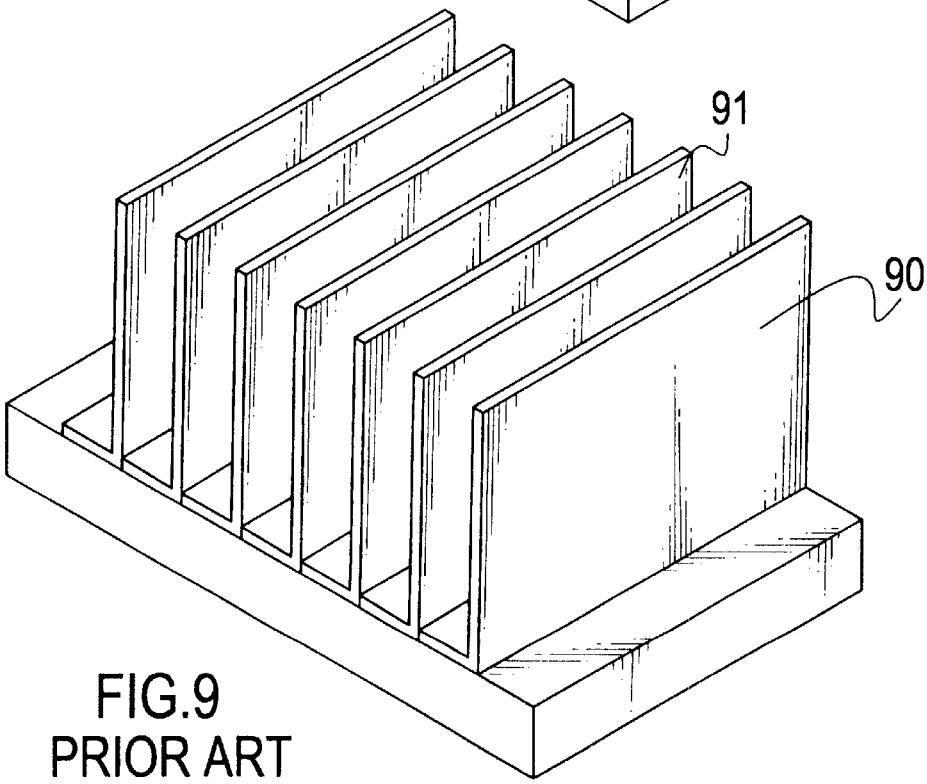
FIG.9 PRIOR ART
FIG. 9 is a perspective view of still another conventional heat dissipation fin.

With reference to FIGS. 5 and 7, the fourth and fifth embodiments of the present invention are shown. The heat dissipation fin (40) is folded according to folds (401) and includes first side walls (43), tops (42), second side walls (44) and bridges (41). Extension of the folds (401) are tangent to an imaginary circle inside the heat dissipation fin (40) of the present invention.

Figure 6:
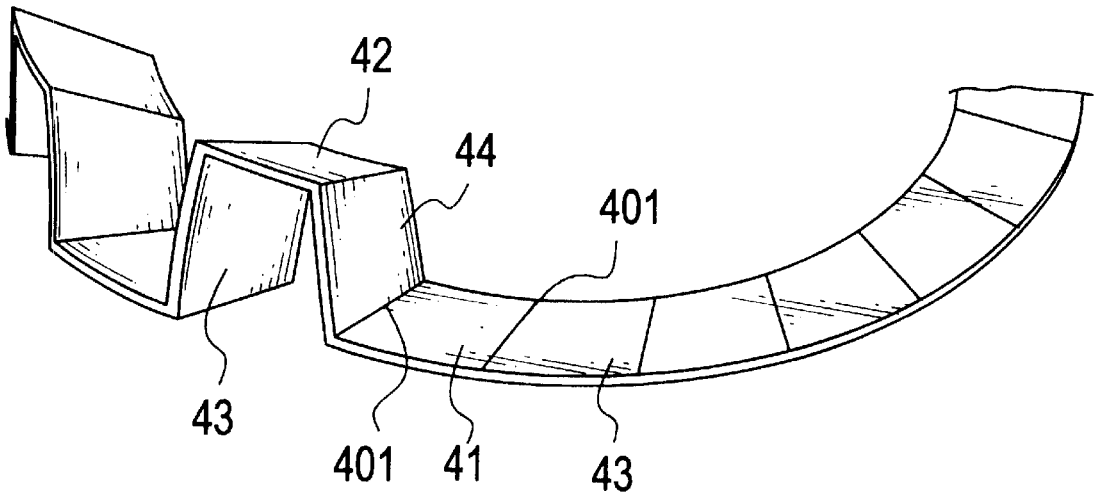
FIG. 6 is a perspective view of the heat dissipation fan as shown in FIG. 5.

With reference to FIGS. 5 and 6, it is noted that the extensions of the folds do not pass through the imaginary circle inside the heat dissipation fin (40,50). From FIG. 6, it is noted that a fan (60*a*) is able to be mounted on top of the tops (52) so that the divergent air flow from the fan (60*a*) is able to flow in directions as shown in the extensions of the folds (401). Because the heat dissipation fin (40,50) of the present invention has a circular or an annular configuration, the bridges (41,51), the tops (42,52) each have a distal end, which faces an imaginary center, with a width larger than that of the other distal end of the bridges (41,51) and the tops (42,52). With such an arrangement, the divergent air flow from the fan (60*a*) matches the divergent arrangement of the fin structure of the present invention.

What is claimed is:

1. A heat dissipation fin comprising:

multiple units each having a top, a first side and a second side; and multiple bridges respectively connecting two adjacent units together and connected to each one of the units at a fold, wherein the bridge has a front side and a rear side and the top of the unit has a first side in parallel with the front side and a second side in parallel with the rear side of the bridge, each front side has a width smaller than a width of each rear side and each first side has a width smaller than a width of each second side, wherein an extension of each of the folds connects with each other at a common point, wherein the bridge, the first side wall, the second side wall and the top are trapezoidal.

2. The heat dissipation fin as claimed in claim 1, wherein the front sides are arranged to form a first imaginary circle and the rear sides are arranged to form a second imaginary circle concentric to the first imaginary circle.

3. The heat dissipation fin as claimed in claim 1, each of the first sides of each of the units has a vertical front side and a vertical rear side with a height smaller than a height of the vertical front side.

4. The heat dissipation fin as claimed in claim 2, each of the first sides of each of the units has a vertical front side and a vertical rear side with a height smaller than a height of the vertical front side.

5. The heat dissipation fin as claimed in claim 3, wherein each of the units and the bridges are integrally formed with each other and are formed by a piece of metal.

6. The heat dissipation fin as claimed in claim 4, wherein the metal piece is spiral.

7. A heat dissipation fin comprising:

multiple units each having a top, a first side and a second side; and multiple bridges each connecting every two adjacent units together and connected to each one of the units at a fold, wherein the bridge has a front side and a rear side and the top of the unit has a first side in parallel with the front side and a second side in parallel with the rear side of the bridge, each front side has a width smaller than a width of each rear side and each first side has a width smaller than a width of each second side, an extension of each fold is a tangent to a pitch circle diameter defined by the dissipation fin so that the divergent air flow of the fan is able to dissipate heat with great effect, wherein each of the units and the bridges are integrally formed with each other and made of a piece of metal.

8. The heat dissipation fin as claimed in claim 7, wherein the front sides are arranged to form a first imaginary circle and the rear sides are arranged to form a second imaginary circle concentric to the first imaginary circle.

9. The heat dissipation fin as claimed in claim 7, wherein the tops of each of the units are flush with one another.

10. The heat dissipation fin as claimed in claim 8, wherein the tops of each of the units are flush with one another.

11. The heat dissipation fin as claimed in claim 7, each of the first sides of each of the units has a vertical front side.and a vertical rear side with a height smaller than a height of the vertical front side.

12. The heat dissipation fin as claimed in claim 8, each of the first sides of each of the units has a vertical front side and a vertical rear side with a height smaller than a height of the vertical front side.

* * * * *